US005443268A

United States Patent [19]

Mayfield et al.

[11] Patent Number: 5,443,268

[45] Date of Patent: Aug. 22, 1995

[54] MILITARY CONFLICT BOARD GAME

[76] Inventors: George M. Mayfield; Gladys L. Mayfield, both of HC 61 Box 51, Calico Rock, Ark. 72519

[21] Appl. No.: 269,018

[22] Filed: Jun. 30, 1994

[51] Int. Cl.[6] ..... A63F 3/02

[52] U.S. Cl. ..... 273/241; 273/262

[58] Field of Search ..... 273/241, 261, 260, 262, 273/271

[56] References Cited

U.S. PATENT DOCUMENTS

| | | | |
|---|---|---|---|
| 964,644 | 7/1910 | Henry | 273/262 |
| 1,405,988 | 2/1922 | Erwin | 273/260 |
| 1,798,701 | 3/1931 | Reed | 273/262 |
| 1,877,154 | 9/1932 | Weaver | 273/241 |
| 3,343,841 | 9/1967 | Arend | 273/262 |
| 4,131,282 | 12/1978 | Boyer et al. | 273/271 |

FOREIGN PATENT DOCUMENTS

| | | | |
|---|---|---|---|
| 1304294 | 12/1962 | France | 273/241 |

*Primary Examiner*—Benjamin H. Layno

[57] ABSTRACT

A multiple-level board invasion game with game piece armaments and personnel comprising an upwardly extended and rigid pedestal; at least two transparent and stacked game boards, each game board having a matrix of spaces with each matrix of each board being of equal size and with the spaces of each matrix defining a level for battle; and a set of game pieces positionable on the levels for battle with the game pieces representing armaments and personnel.

3 Claims, 4 Drawing Sheets

MILITARY CONFLICT BOARD GAME

BACKGROUND OF THE INVENTION

1. Field of the Invention

The present invention relates to a multiple-level board invasion game with game piece armaments and personnel and more particularly pertains to allowing the positioning of game pieces on a multiple-level game board for simulating a sea, land, and air battle for jeopardizing the security of an opponent's capital with a multiple-level board invasion game with game piece armaments and personnel.

2. Description of the Prior Art

The use of multiple-level game boards is known in the prior art. More specifically, multiple-level game boards heretofore devised and utilized for the purpose of playing games of battle are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,767,2071 to Harper et al. discloses a multi-level game board structure for three-dimensional chess and checker games. U.S. Pat. No. 3,917,273 to Blakewood, III discloses a multiple chess or checker game board. U.S. Pat. No. 3,937,471 to Brennan discloses a multiple-board chess game with additional chessman. U.S. Pat. No. 5,031,917 to Greene discloses a three dimensional chess game. U.S. Pat. No. 5,100,149 to Olfma et al. discloses a three level game board.

While these devices fulfill their respective, particular objective and requirements, the aforementioned patents do not describe a multiple-level board invasion game with game piece armaments and personnel that allows players to battle each other on multiple battlefields with armaments and personnel to jeopardize each other's capitals.

In this respect, the multiple-level board invasion game with game piece armaments and personnel according to the present invention substantially departs from the conventional concepts and designs of the prior art, and in doing so provides an apparatus primarily developed for the purpose of allowing the positioning of game pieces on a multiple-level game board for simulating a sea, land, and air battle for jeopardizing the security of an opponent's capital.

Therefore, it can be appreciated that there exists a continuing need for new and improved multiple-level board invasion game with game piece armaments and personnel which can be used for allowing the positioning of game pieces on a multiple-level game board for simulating a sea, land, and air battle for jeopardizing the security of an opponent's capital. In this regard, the present invention substantially fulfills this need.

SUMMARY OF THE INVENTION

In the view of the foregoing disadvantages inherent in the known types of multiple-level game boards now present in the prior art, the present invention provides an improved multiple-level board invasion game with game piece armaments and personnel. As such, the general purpose of the present invention, which will be described subsequently in greater detail, is to provide a new and improved multiple-level board invasion game with game piece armaments and personnel and method which has all the advantages of the prior art and none of the disadvantages.

To attain this, the present invention essentially comprises, in combination, an upwardly extended and rigid pedestal having an upper end, a lower end, and intermediate location defined therebetween. A first game board, a second game board, and a third game board are included with each game board being equally sized, square, and transparent. Each game board has an upper surface and a lower surface and a peripheral edge thereabout defined by a home side adapted to be positioned adjacent to a home player, an opponent side adapted to be positioned adjacent to an opponent player, an opposed side edges extended between the home side and the opponent side. Each game board is delineated by a $9\times9$ matrix of square spaces inscribed on the upper surface thereof with each matrix on each board being of equal size and with the spaces thereof defining a level for battle. Each level is further delineated by a pair of broadened, spaced, and parallel lines extended across the $9\times9$ matrix and aligned therewith to divide each level into three equal portions such that the broadened line positioned nearest the home side is defined as the home front and the broadened line positioned nearest the opponent side is defined as the opponent home front. Each portion is divided by a pair of broadened, spaced, and parallel lines extended between the home edge and the opponent edge and aligned with the matrix to divide each portion into three equal sectors with the sectors each a consisting of a $3\times3$ matrix of square spaces. The first game board is coupled to the lower end of the pedestal to define a base adapted to rest on a generally level surface and further define a first level for battle at sea. The second board is coupled to the intermediate location of the pedestal directly above and aligned with the first game board to define a second level for battle on land. The third game board is coupled to the upper end of the pedestal directly above and aligned with the second game board to define a third level for battle in air.

A set of 72 game pieces is included and has a first subset of 36 home game pieces initially positioned near the home side and a second subset of 36 opponent game pieces initially positioned near the opponent side to start a game. The game pieces in each subset represent two below surface missiles, two submarines, two destroyers, and three aircraft carriers with the surface missiles, submarines, destroyers, and aircraft carriers positionable for battle on the first level, a patriot (an anti-missile missile), ten soldiers, two surface missiles, two cannon, two tanks, a general, a president, a congress, and an intercontinental ballistic missile with the patriot, soldiers, surface missiles, cannons, tanks, general, president, congress, and intercontinental ballistic missile positionable for battle on the second level, and three fighter planes, two fighter bombers, and a bomber with the fighter planes, fighter bombers, and bomber positionable for battle on the third level.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple-level board invasion game with game piece armaments and personnel which has all the advantages of the prior art multiple-level game boards and none of the disadvantages.

It is another object of the present invention to provide a new and improved multiple-level board invasion game with game piece armaments and personnel which may be easily and efficiently manufactured and marketed.

It is a further object of the present invention to provide a new and improved multiple-level board invasion game with game piece armaments and personnel which is of durable and reliable construction.

An even further object of the present invention is to provide a new and improved multiple-level board invasion game with game piece armaments and personnel which is susceptible of a low cost of manufacture with regard to both materials and labor, and which accordingly is then susceptible of low prices of sale to the consuming public, thereby making such a multiple-level board invasion game with game piece armaments and personnel economically available to the buying public.

Still yet another object of the present invention is to provide a new and improved multiple-level board invasion game with game piece armaments and personnel which provides in the apparatuses and methods of the prior art some of the advantages thereof, while simultaneously overcoming some of the disadvantages normally associated therewith.

Even still another object of the present invention is to provide a new and improved multiple-level board invasion game with game piece armaments and personnel for allowing the positioning of game pieces on a multiple-level game board for simulating a sea, land, and air battle for jeopardizing the security of an opponent's capital.

Lastly, it is an object of the present invention to provide a new and improved multiple-level board invasion game with game piece armaments and personnel comprising an upwardly extended and rigid pedestal; at least two transparent game boards, each game board having a matrix of spaces with each matrix of each board being of equal size and with the spaces of each matrix defining a level for battle; and a set of game pieces positionable on the levels for battle with the game pieces representing armaments and personnel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

FIRST ROW: the soldier, patriot, inter-continental ballistic missile (ICBM), and cannon SECOND ROW: tank, general, president, and congress THIRD ROW: surface missile, below surface missile, submarine, and destroyer FOURTH ROW: aircraft carrier, fighter plane, fighter bomber, and bomber

The same reference numerals refer to the same parts through the various Figures.

DESCRIPTION OF THE PREFERRED EMBODIMENT

Figure 1:
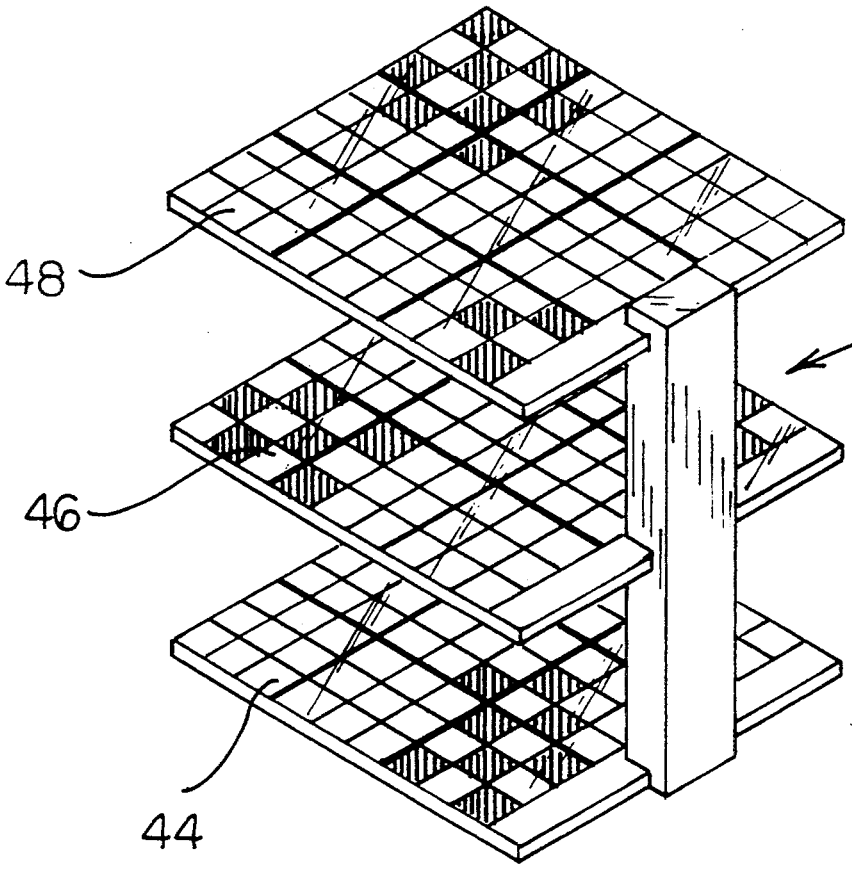
FIG. 1 is a perspective view of the preferred embodiment of the multiple-level board invasion game constructed in accordance with the principles of the present invention.
Figure 2:
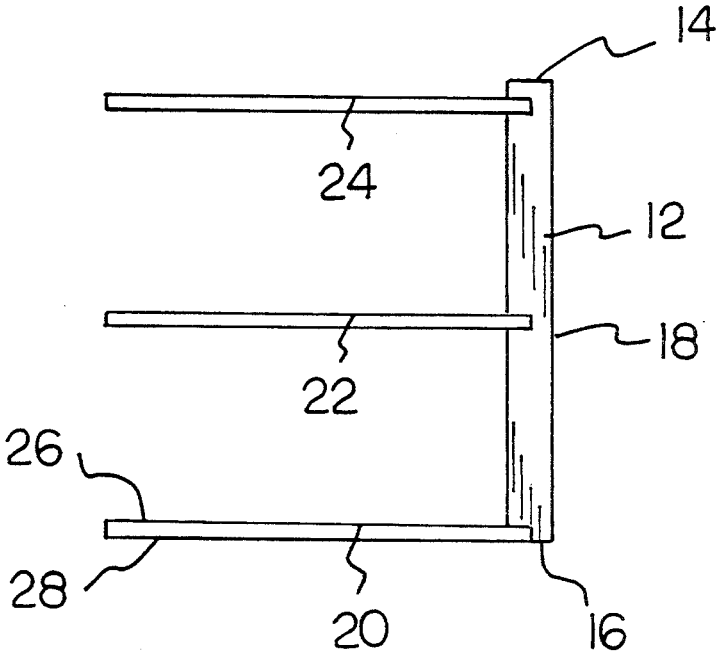
FIG. 2 is a side elevational view of the playing table as depicted in FIG. 1.
Figure 3:
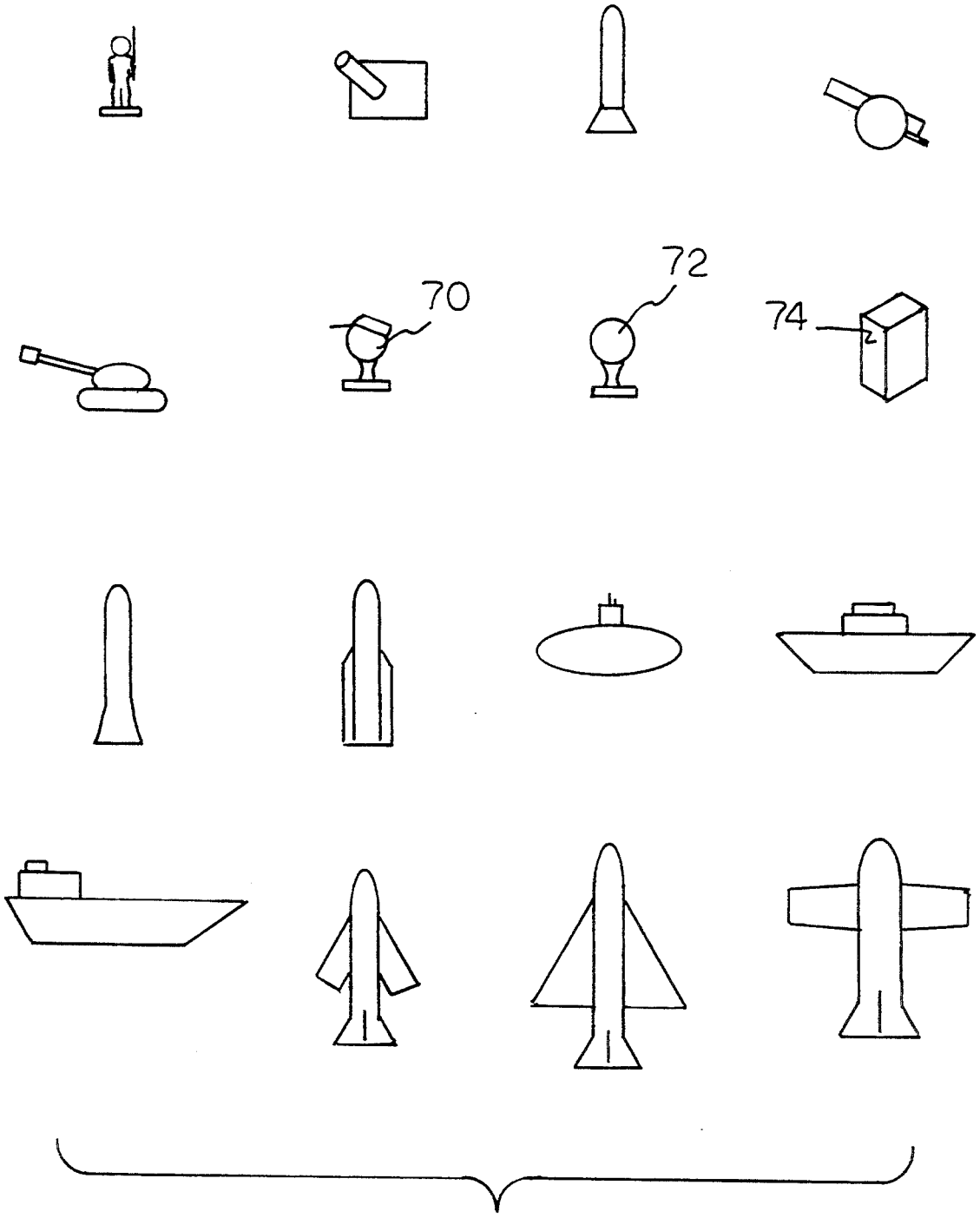
FIG. 3 depicts various game pieces of the present invention. The various game pieces shown are, from left to right.
Figure 4:
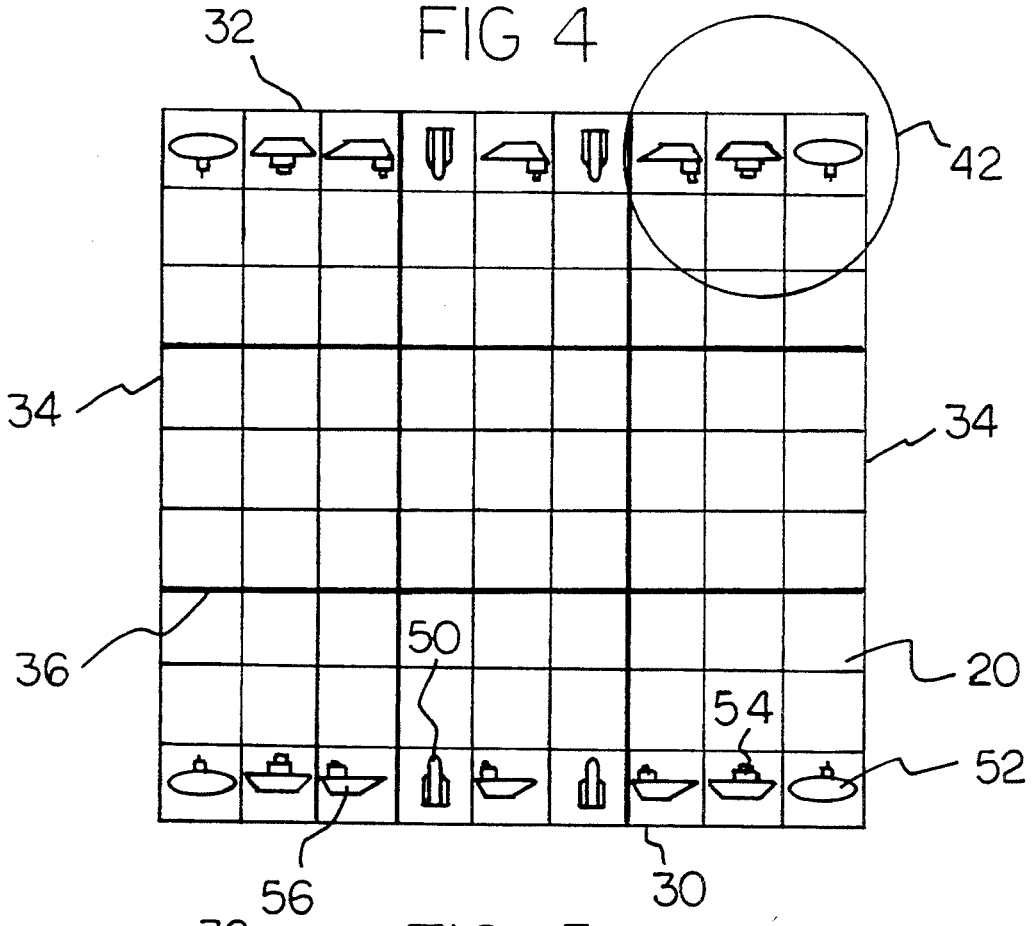
FIG. 4 is a plan view of the first level utilized for battle at sea.
Figure 5:
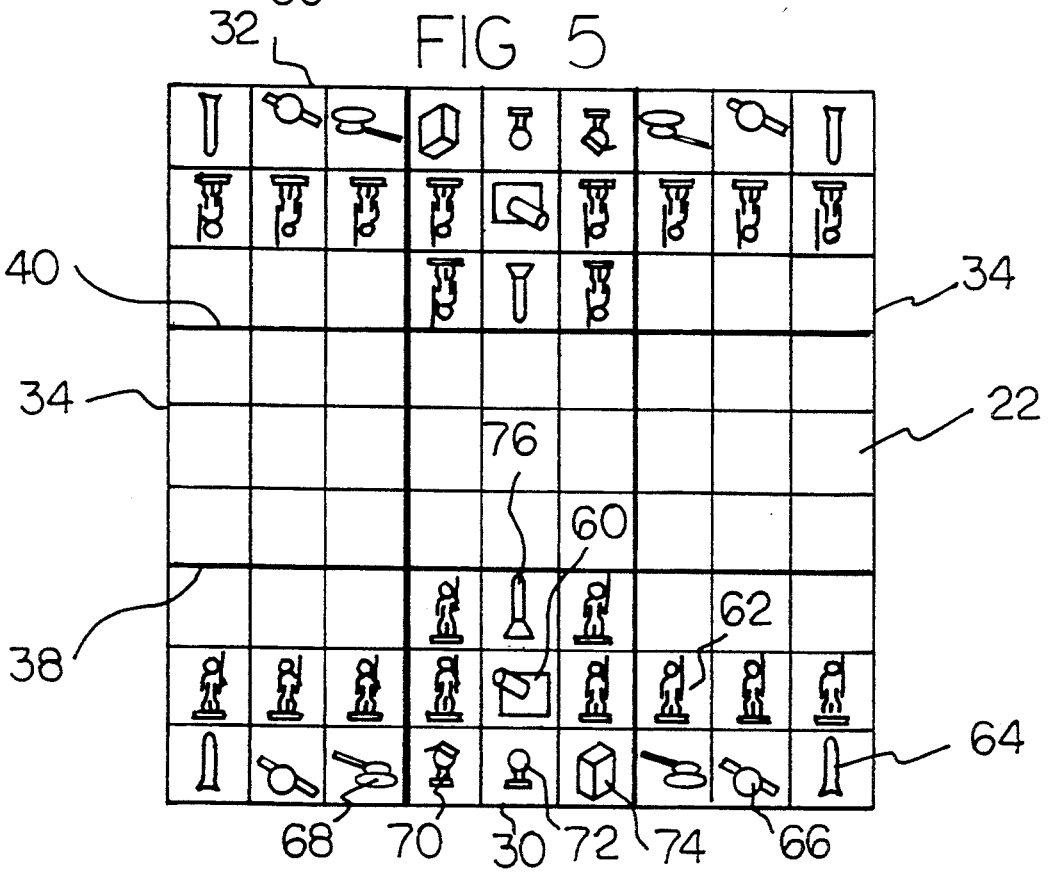
FIG. 5 is a plan view of the second level utilized for battle on land.
Figure 6:
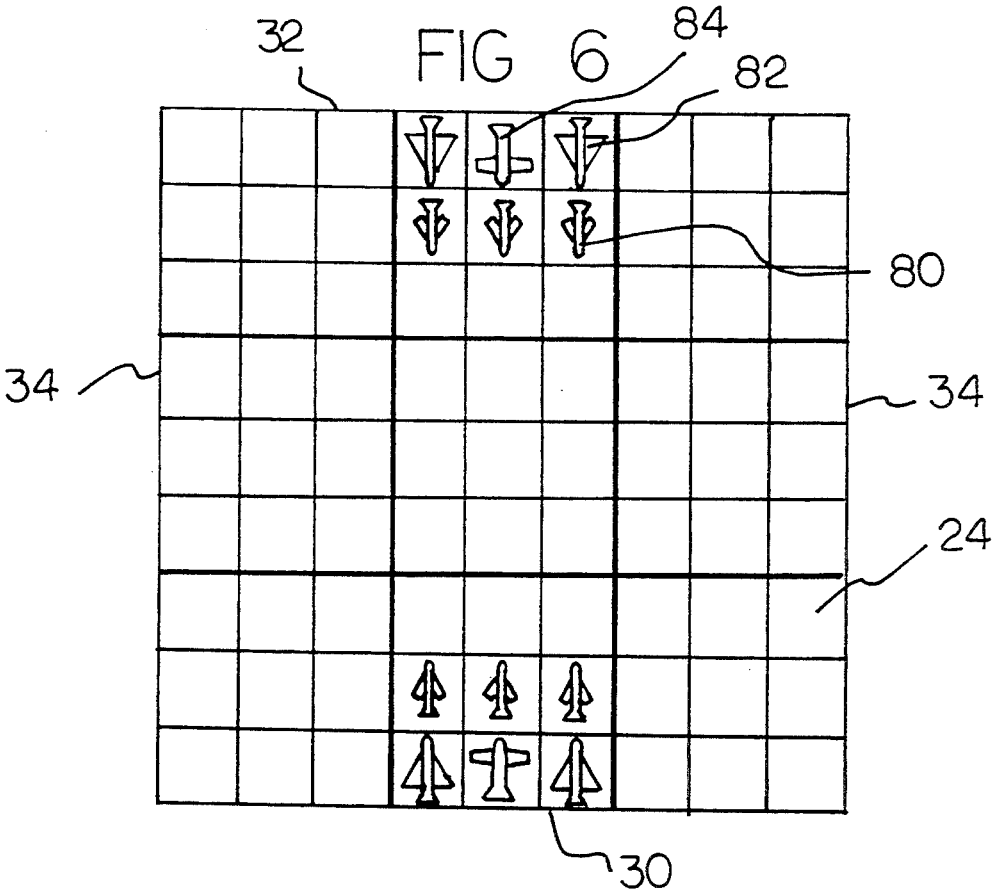
FIG. 6 is a plan view of the third level utilized for battle in air.

With reference now to the drawings, and in particular, to FIG. 1 thereof, the preferred embodiment of the new and improved multiple-level board invasion game with game piece armaments and personnel embodying the principles and concepts of the present invention and generally designated by the reference number 10 will be described.

Specifically, the present invention includes three major components. The major components are pedestal, game boards, and game pieces. These components are interrelated to provide the intended function.

More specifically, it will be noted in the various FIGS. that the first major component is the pedestal 12. The pedestal is rigid in structure. The pedestal is extended in an upward fashion and adapted for holding game boards. The pedestal has an upper end 14, a lower end 16, and an intermediate location 18 defined therebetween.

The second major component is the game boards. The present invention includes a first game board 20, a second game board 22, and a third game board 24. Each game board is of an equal size, square, and transparent. Each game board has an upper surface 26 and a lower surface 28. A peripheral edge is extended around the board and defined by a home side 30 adapted to be positioned adjacent to a home player, and an opponent side 32 adapted to be positioned adjacent to an opponent player, and opposed side edges 34 extended between the home side and the opponent side.

Each game board is delineated by a 9×9 matrix of square spaces 36 inscribed on the upper surface. Each matrix on each board is of an equal size with the spaces thereof defining a level of battle. Each level is further delineated by a pair of broadened, spaced, and parallel lines extended across the 9×9 matrix and aligned therewith to divide each level into three equal portions. The broadened line positioned nearest the home side is defined as the home front 38. The broadened line positioned nearest the opponents side is the defined as the opponents home front 40. Each portion of a level is divided by a pair of broadened, spaced, and parallel lines extended between the home side and the opponent side and aligned with the matrix to divide each portion into three equal sectors 42. The delineation of the pairs of broadened lines thus divides the level into nine sectors with each sector consisting of a 3×3 matrix of square spaces.

The first game board is coupled to the lower end 16 of the pedestal to define a base adapted to rest on a generally level surface. The first game board further defines a first level 44 for battle at sea. The second board is coupled to the intermediate location 18 of the pedestal directly above and aligned with the first game board and its matrix to define a second level 46 for battle on land. The third game board is coupled to the upper end 14 of the pedestal directly above and aligned with the second game board and its matrix to define a third level 48 for battle in air.

The third major component is the game pieces. The present invention includes a set of seventy-two game pieces. This set has a first subset of thirty-six home game pieces initially positioned near the home side 30 and a second subset of thirty-six opponent game pieces initially positioned near the opponent side 32 to start a game. The game pieces in each subset represent various armament and personnel for battle at various levels. Two below surface missiles 50, two submarines 52, two destroyers 54, and three aircraft carriers 56 are positionable for battle on the first level 44. A patriot 60, ten soldiers 62, two surface missiles 64, two cannons 66, two tanks 68, a general 70, a president 72, a congress 74, and an intercontinental ballistic missile 76 are positionable for battle on the second level 46. Lastly, three fighter planes 80, two fighter bombers 82, and a bomber 84 are positionable for battle on the third level 48.

Specifically, the present invention is a tactical board game or, more accurately, a multi-board game. Three colored and transparent boards are used to play the game, and these are arranged in a stacked and spaced configuration with each of the boards aligned with that above or below it; the board at level one is green checkerboard while those at levels two and three respectively are brown checkerboard and blue checkerboard. Each board has nine equally sized sectors, and each sector has nine equally sized square areas; it is on these areas that the playing pieces are placed in accordance with the instructions provided with the game.

Figure 7:
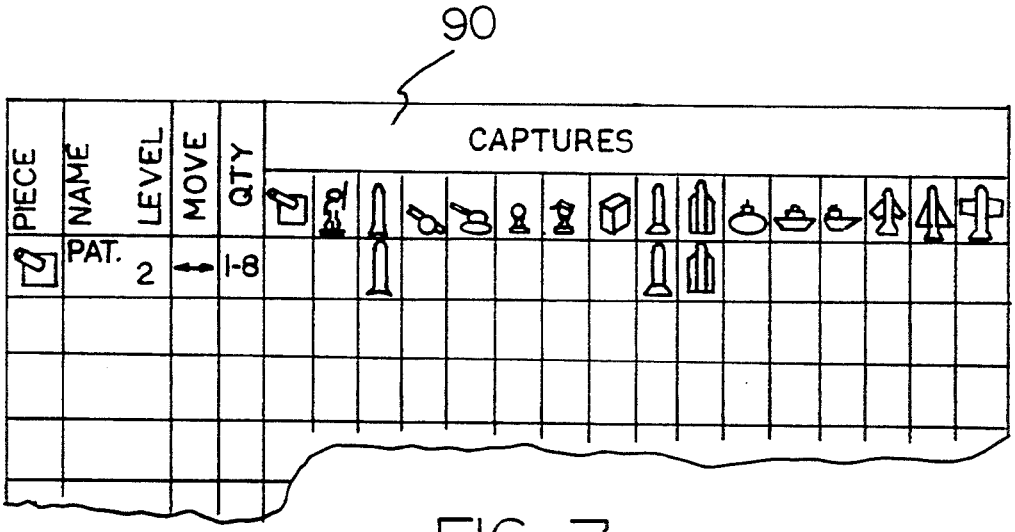
FIG. 7 is a portion of an instruction chart for the game pieces. For example, it is shown in this chart that a patriot game piece is played on the second level and may move sideways on the level between one and eight spaces. The patriot can eliminate a surface missile, an intercontinental ballistic missile (ICBM), or a below surface missile. Instructions of this type are provided with the game.

The instructions are provided in a grid-like chart (FIG. 7). The first two columns delineate the symbol for each playing piece and its name. The third column has an appropriate set of arrows illustrating exactly the way each game piece moves; these patterns can be lateral, forward and backward, diagonal or any combination of the three, and the fourth column lists the permissible number of spaces which can be traversed. The symbols for those pieces, which that in the left column can attack and destroy, are shown across the remainder of the rows in the chart.

There are total of thirty six game pieces for each side, and each game piece is formed in a miniaturized shape which is symbolic of its nature. There are playing pieces which represent personnel, such as the general, the president and the congress, and there are pieces for combat weapons and carriers, such as an ICBM missile, an aircraft carrier, a fighter plane, and other such armaments.

Each playing piece "attacks" in a vertical direction. That is, if a piece having the power to destroy a second piece is directly above or below that second piece, the second piece will be deemed to have been destroyed and removed from the board unless the player moves it in his/her current turn. The object of the game is to jeopardize the opponent's capitol, and the opponent must surrender unless he/she can destroy the attacking piece at the next turn. The present invention can be played with up to six players on two teams with each opposing pair of players on each team being responsible for the moves at any given level.

More specifically, invasion is a three dimensional game with three levels of play. The game is played on three levels. Each level is divided into nine sectors, and each sector is divided into nine areas. Sectors are numbered with respect to the home side from bottom to top and from left to right. The Capital sector for the home player is designated as sector 2 and the Capital sector for the opponent is designated as sector 8. Furthermore, a sector on levels 1, 2, and 3 is designated as the same sector. For example, if an aircraft carrier enters sector 1 area 8 on level 1, and your opponent has a cannon in the same sector 1 area 8, on level 2 you have just knocked out his cannon. Only the cannon is removed from the board. If your opponent moves a plane into sector 5, area 9, on level 3, your missile on level 2 can be moved to sector 5, area 9, on level 2, and knock out his plane. Your missile and the plane must then be removed from the board. Missiles are always removed after firing. Game pieces do not go from level to level, but affect the game pieces in the same sector on all levels. If you look through the levels from the top down for each sector, no two pieces may occupy the same areas in that sector as long as one game piece has power (can knock out)

over the other, unless your opponent doesn't notice. On the other hand a submarine on level 1, sector 6, area 5 and a plane on level 3, sector 6, area 5 can occupy the same areas because neither has power over the other. One game piece may take out two or the opponent's game pieces if they are in the same areas of a sector. The game piece must have power over both of the opponent's pieces, otherwise he will remove your piece on his turn plus getting to move that piece or another. The object of the game is to jeopardize the security of your opponent's capitol. Sectors 1, 2, and 3 are known as the home front. Your opponent may see the board from his own perspective. What is sector 1 to you may be sector 9 to him.

An opponents capitol is in jeopardy when his patriot game piece is taken and you have an ICBM left. If your opponent can knock out your ICBM with his bomber before you declare the firing of it, his sector is safe. An opponent's capitol is also in jeopardy when your bomber reaches his safe sector. If your opponent can knock out your bomber on the following move his capitol is safe again. If your opponent's capitol is secure because you have lost your ICBM and bomber, and you are not in jeopardy, it is up to your soldiers, general, or president to put the opponent's president in jeopardy by blocking his move or capturing him (force to surrender). An opponent must surrender when he can't retaliate against a threat by an ICBM, bomber, or the capture of his president. The object is not to destroy the capitol or president, but to force your opponent to surrender. Who begins first is determined by the toss of a coin, etc.

A variation of the game can be played by six players. One player for each level. Again, who begins first may be determined by the toss of a coin, etc. Level one player on the side that won the toss will begin. Level one player on the opponent's team will move next. Then players on level 2 will take turns in order and level 3 will be last. Play will continue in this order until the opponent's capitol or president is in jeopardy. Players on a team may consult with each other before moving. A player on one level may let another player on his team move in his stead, on another level, only, if their capitol or president is in jeopardy. The following Terms are utilized in the game:

Terms

1. Level-A level refers to one of three game boards used. Every level contains nine sectors with nine areas. (blocks)
2. Sectors-One of nine sections on any level.
3. Arees-One of nine blocks in a sector.
4. Space-The part of a specific area or sector from level one to level three. Such as, area 2, sector 50 is within the same space as, area 2, sector 5, in levels 1, 2, and 3.
5. Safe Sectors-Sectors 2 and 8 on level two.
6. Capitol-Safe sectors on level two
7. Opponent-The person playing against you.
8. Jeopardy-Jeopardy is when a capitol is in danger of an ICBM or bomber attach. Also the president can be in jeopardy if he is about to be captured.
9. Secure-Not in danger of immediate attack.

The Key below is defined to describe the capabilities of the armaments and personnel in the Table that follows:

Key

1=patriot
2=soldier
3=surface missile
4=cannon
5=tank
6=general
7=president
8=congress
9=ICBM missile
10=below surface missile
11=submarine
12=destroyer
13=aircraft carrier
14=fighter plane
15=fighter bomber
16=bomber
A=forwards
B=diagonally forwards
C=backwards
D=diagonally backwards
E=sideways
F=forwards, sideways right or left, and diagonally forwards right or left

| Game Piece | Name and Level | Direction of Move | # of Spaces Moved | Captures and Eliminates | | | | | | | | | | | | | | | |
|---|---|---|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 | 14 | 15 | 16 |
| 1 | Patriot | E | 1-8 | | | | | | | | | x | x | | | | | | |
| 2 | Soldier | A | 1 | x | x | x | x | | x | x | | | | | | | | | |
| 3 | Surface Missile | F | 1-7 | | x | | x | x | x | | | | | | x | x | x | x | |
| 4 | Cannon | A,B,E | 1-3 | | x | x | x | | x | | | | | | | | | | |
| 5 | Tank | A,B,C,D,E | 1 | | x | x | x | x | x | | | | | | | | | | |
| 6 | General | A,B,C,D,E | Unlimited | x | x | x | x | | x | x | | | | | | | | | |
| 7 | President | A,B,C,D,E | 1 | | | | | | | x | | | | | | | | | |
| 8 | Congress | A,C,E | Unlimited | | | | | | | | | | | | | | | | |
| 9 | ICBM Missile | A,B | 1-5 | | | | | | | | | | | | | | | | |
| 10 | Below Surface Missile | A,B | 1-5 | | | | | | | | | | | | x | x | x | x | x |
| 11 | Submarine | B,D on green | 1 | | | | | | | | | | | x | x | x | x | x | x |
| 12 | Destroyer | A,E | 1-2 | | | x | x | x | | | | x | | x | x | x | x | x | |
| 13 | Aircraft Carrier | A,B,E | 1 | | | x | x | x | | | | x | | | x | x | x | x | |
| 14 | Fighter Plane | A,B,E | 1-2 | | | | | | | | | | | | | | x | x | x |
| 15 | Fighter Bomber | B only on white or clear (transparent) | 1 | | x | x | x | x | x | | | x | | | x | x | x | x | |
| 16 | Bomber | B any direction | 1 | x | | x | | | | | | x | | | x | x | x | | x |

-continued

| Game Piece | Name and Level | Direction of Move | # of Spaces Moved | Captures and Eliminates 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|---|
| | | on blue | | | | | | | | | | | | | | | | | |

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A multiple-level board invasion game with game piece armaments and personnel comprising, in combination:

an upwardly extended and rigid pedestal having an upper end, a lower end, and intermediate location defined therebetween;

a first game board, a second game board, and a third game board, each game board being equally sized, square, and transparent, each game board having an upper surface and a lower surface and a peripheral edge therearound defined by a home side adapted to be positioned adjacent to a home player, an opponent side adapted to be positioned adjacent to an opponent player, an opposed side edges extended between the home side and the opponent side, each game board delineated by a 9×9 matrix of square spaces inscribed on the upper surface thereof with each matrix on each board being of equal size and with the spaces thereof defining a level for battle, each level further delineated by a pair of broadened, spaced, and parallel lines extended across the 9×9 matrix to divide each level into three equal portions such that the broadened line positioned nearest the home side is defined as the home front and the broadened line positioned nearest the opponent side is defined as the opponent home front, each portion divided by a pair of broadened, spaced, and parallel lines extended between the home edge and the opponent edge and aligned with the matrix to divide each portion into three equal sectors with the sectors each a consisting of a 3×3 matrix of square spaces, the first game board coupled to the lower end of the pedestal to define a base adapted to rest on a generally level surface and further define a first level for battle at sea, the second board coupled to the intermediate location of the pedestal directly above and aligned with the first game board to define a second level for battle on land, and the third game board coupled to the upper end of the pedestal directly above and aligned with the second game board to define a third level for battle in air; and a set of 72 game pieces having a first subset of 36 home game pieces initially positioned near the home side and a second subset of 36 opponent game pieces initially positioned near the opponent side to start a game with the game pieces in each subset representing two below surface missiles, two submarines, two destroyers, and three aircraft carriers with the surface missiles, submarines, destroyers, and aircraft carriers positionable for battle on the first level, a patriot, ten soldiers, two surface missiles, two cannon, two tanks, a general, a president, a congress, and an intercontinental ballistic missile with the patriot, soldiers, surface missiles, cannons, tanks, general, president, congress, and intercontinental ballistic missile positionable for battle on the second level, and three fighter planes, two fighter bombers, and a bomber with the fighter planes, fighter bombers, and bomber positionable for battle on the third level.

2. A multiple-level board invasion game with game piece armaments and personnel comprising, in combination:

an upwardly extended and rigid pedestal;

at least two transparent game boards, each game board having a matrix of spaces with each matrix of each board being of equal size and with the spaces of each matrix defining a level for battle, each level being further delineated by a first pair of broadened, spaced, and parallel lines extending across and aligned with the matrix to divide each level into equal portions, one broadened line is defined as the home front and the other broadened line is defined as the opponent home front; and a set of game pieces positionable on the levels for battle with the game pieces representing armaments and personnel.

3. A multiple-level board invasion game with game piece armaments and personnel comprising:

an upwardly extended and rigid pedestal;

at least two transparent game boards, each game board having a matrix of spaces with each matrix of each board being of equal size and with the spaces of each matrix defining a level for battle;

each level being further delineated by a first pair of broadened, spaced, and parallel lines extending across and aligned with the matrix to divide each level into equal portions, one broadened line is defined as the home front and the other broadened line is defined as the opponents home front;

a set of game pieces positionable on the levels for battle with the game pieces representing armaments and personnel; and each level of each game board being divided by a second pair of broadened, spaced, and parallel lines extending across the matrix at an orientation perpendicular to the first pair to divide the level into sectors.

* * * * *